US005194680A

United States Patent [19]

Reineck

[11] Patent Number: 5,194,680

[45] Date of Patent: Mar. 16, 1993

[54] STRINGED INSTRUMENT PLECTRUM

[76] Inventor: Robert W. Reineck, 10651 Johnson St., NE., Blaine, Minn. 55434

[21] Appl. No.: 761,415

[22] Filed: Sep. 17, 1991

[51] Int. Cl.[5] ..... G10D 3/16

[52] U.S. Cl. ..... 84/320; 84/322

[58] Field of Search ..... 84/322, 320

[56] References Cited

U.S. PATENT DOCUMENTS 4,253,372 3/1981 Filipetti ..... 84/322

*Primary Examiner*—Michael L. Gellner
*Assistant Examiner*—Eddie C. Lee
*Attorney, Agent, or Firm*—Patterson & Keough

[57] ABSTRACT

The disclosed plectrum is a relatively non-resilient planar member composed of a soft metal such as aircraft aluminum or other like material. The string-engaging tip of the plectrum is rounded and bevelled for optimum harmonic attack of metallic strings of electrical guitars and other like instruments. The surface of the plectrum may be anodized with metallic oxide coatings of a variety of colors.

4 Claims, 1 Drawing Sheet

STRINGED INSTRUMENT PLECTRUM

FIELD OF THE INVENTION

This invention relates to a stringed instrument plectrum, or musician's pick, for stringed instruments with metallic strings. In particular it pertains to a stringed instrument plectrum having a string-engaging tip portion with beveled margins and composed of materials providing for optimum engagement with metallic strings for the generation of controlled and sustainable sound frequencies.

BACKGROUND OF THE INVENTION

Picks, or plectrums, for stringed instruments such as guitars have been known and utilized for many years. Such plectrums are generally of an overall triangular or teardrop shape, having parallel opposed surfaces, and are adapted for holding between thumb and forefinger.

Conventional picks have been designed for use with various string types used on instruments and in accordance with various styles and techniques of playing. Conventional picks are composed of wood, plastic, metals and other materials, with the picks having various thicknesses depending on the composition and intended use of the pick. Plastic picks of appropriate resiliency have been favored for non-metallic strings. Resilient, or relatively flexible, picks are appropriate for strumming or other like plucking of instrument strings. However, such resilient picks do not provide for precision articulation in string plucking since displacement of the tip and/or imperfect "memory" in return of the tip to its rest position following release from the string does not allow the musician precise knowledge of tip position.

Picks composed of metal have been favored for plucking metallic strings of electrical guitars and like instruments. The strings of such instruments frequently have a round-wound nickel-silver composition. Some of the prior art metallic picks have been composed of metallic alloys imparting resilience to such metallic picks. Such resilient metallic picks are exemplified in U.S. Pat. No. 4,395,932, Stringed Instrument Pick, in which a thin metallic pick is composed of beryllium copper alloy. In recent years musicians utilizing electrical guitars or like instruments having metallic strings have developed styles requiring a precision articulation, or closely defined plucking style. Resilient picks, even those with relatively quick and accurate return to the rest position, may be inadequate for precision articulation of metallic strings in the manner required for the newer styles of musicianship with electrical guitars and like instruments.

As a consequence, metallic picks composed of hard metals such as stainless steel, or even shaved metal coins, have been favored for precision articulation of metallic strings on electrical guitars and similar instruments. Such hard metal picks, however, do not provide sufficient "grab" or "bite" of the strings so as to produce an optimum harmonic attack. In addition, most such hard metal picks have not had rounded or bevelled edges. Rather, such picks have utilized generally sharp right angle edges for engagement with nickel-silver or other metallic strings. Engagement with the hard metallic edges of such picks generally has an adverse impact on the structural integrity of such metallic strings.

SUMMARY OF THE INVENTION

A plectrum for string instruments such as electrical guitars having metallic strings is disclosed herein. The plectrum is a generally planar, generally non-resilient member and is composed of soft metal such as aircraft aluminum or like material, and presents a gripping portion and a rounded, bevelled tip portion having a rounded tip apex. The plectrum preferably has at least two bevelled tip portion edges, each with a generally linear margin, with the tip apex formed from the intersection of two of the linear margins. The tip portion edges may be bevelled from both the upper and lower surfaces of the plectrum. Preferably the plectrum is anodized with a colored coating.

In a preferred embodiment, the upper surface of the plectrum may be generally parallel to the lower surface with a peripheral edge extending therebetween. The peripheral edge comprises a gripping portion edge in the gripping portion of the plectrum, and comprises left and right tip portion edges in the tip portion of the plectrum. The left and right tip portion edges present a generally planar upper bevelled surface and a generally planar lower bevelled surface extending from the upper and lower surfaces respectively of the plectrum. These upper and lower bevelled surfaces intersect along the linear margins of the tip portion edges.

It is preferred that the plectrum tip portion be rounded along the tip apex to form a radiused transverse tip margin and a radiused normal tip margin. The radiused normal tip margin extends between the upper bevelled surface and the lower bevelled surface and is oriented generally normal to the transverse tip margin. In a preferred embodiment, the radius of the transverse tip portion is not more than about 0.05 mm and not less than about 0.01 mm, and the radius of the normal tip margin is not more than about 0.03 mm and not less than about 0.005 mm.

DESCRIPTION OF THE PREFERRED EMBODIMENT

Figure 1:
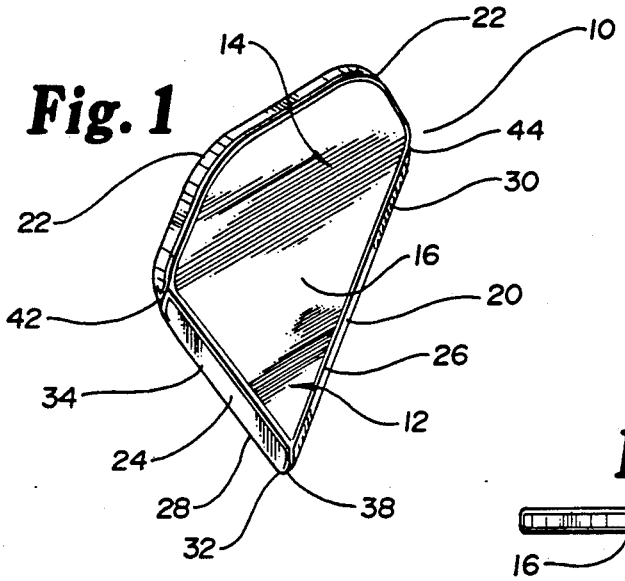
FIG. 1 is a front perspective view of the plectrum in accordance with the present invention.
Figure 2:
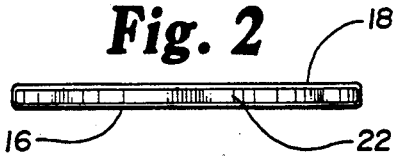
FIG. 2 is a top plan view of the plectrum.
Figure 3:
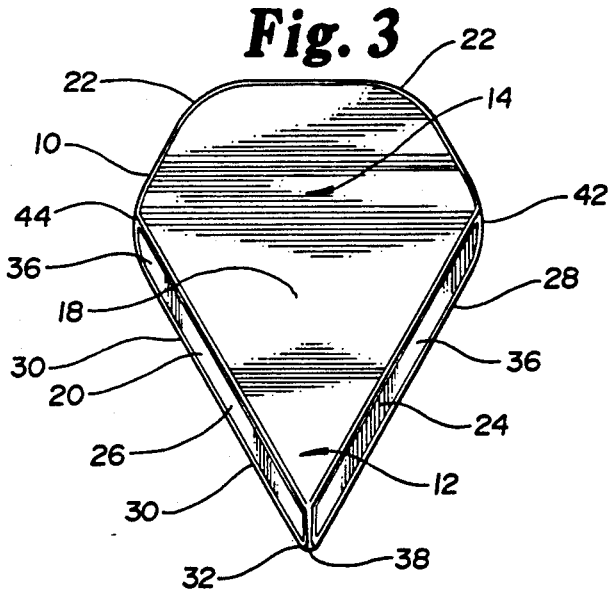
FIG. 3 is a back elevational view of the plectrum.
Figure 4:
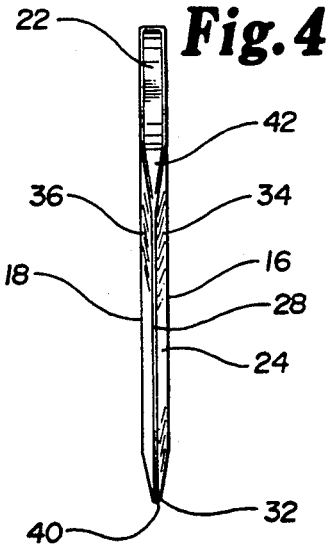
FIG. 4 is a left side elevational view of the plectrum.
Figure 5:
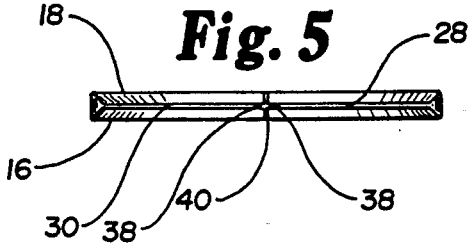
FIG. 5 is a bottom plan view of the plectrum.

Referring now to the Figures, a pick 10 embodying the invention comprises a tip portion 12 and a gripping portion 14. The pick 10 is a generally planar member having a generally flat upper surface 16 and a generally flat lower surface 18, with a peripheral edge 20 extending therebetween. The peripheral edge 20 presents a gripping portion edge 22 and left and right tip portion edges 24, 26, respectively. The left and right tip portion edges present left and right, generally linear, margins 28, 30, respectively. The left and right linear margins 28, 30 intersect to form a plectrum tip apex 32. The upper 16 and lower 18 surfaces of the pick 10 may be mirror images of each other.

In the preferred embodiment, an upper bevelled surface 34, that is, a bevelled surface deriving from the upper surface 16, and a lower bevelled surface 36, that is, a bevelled surface deriving from the lower surface 18, intersect along the right and left linear margins 28, 30. The upper and lower bevelled surfaces, 34, 36 respectively, are mirror images of each other. The left and right linear margins, 28, 30 are, therefore, equidistant from the upper surface 16 and the lower surface 18. It will be understood that other bevelling configurations may be applied to the left and right tip portion edges 24, 26 of the present invention. For example the left and right linear margins 28 and 30 may be closer to either of the upper surface 16 or lower surface 18 than to the corresponding other surface, or even coplanar with either of said surfaces, without departing from the spirit of the present invention.

The plectrum tip portion 12 is preferably rounded along the tip apex 32. In the preferred embodiment, the plectrum tip apex presents a radiused transverse tip margin 38, and a radiused normal tip margin 40 extending between the upper bevelled surface 24 and the lower bevelled surface 26 and oriented generally normal to the transverse tip margin 38. In the preferred embodiment, the radiused transverse tip margin 38 may have a radius of curvature of 0.03 mm plus or minus 0.02 mm, the radiused normal tip margin 40 may have a radius of curvature of 0.01 mm plus 0.02 mm or minus 0.005 mm, and the distance from the upper surface 16 to the lower surface 18 may be 0.062 mm plus or minus 0.015 mm.

In the preferred embodiment, the pick 10 is composed of aircraft aluminum No. 6061T6 AL or like soft metal, and the above enumerated dimensions are appropriate for such composition. It is to be understood that other dimensions of the pick 10 may be employed by those skilled in the art to accommodate various plucking requirements or other soft metals or like materials.

The gripping portion edge 22 of the pick 10 may have a variety of configurations adapted for convenient handling of the pick 10 by a musician. In a preferred embodiment as depicted in the Figures, the gripping portion edge 22 is not bevelled but is configured as a planar surface normal to the upper surface 16 and lower surface 18. The gripping portion edge meets the left tip portion edge 24 and the right tip portion edge 26 at points 42 and 44, respectively. Each of the lengths of the left and right tip portion edges 24, 26 is thereby defined by an end at the tip apex 32 and an opposed end at point 42 or point 44, respectively.

The upper surface 16 and lower surface 18 of the pick 10 may be stamped with a variety of knurling patterns to facilitate gripping of the pick 10 between thumb and forefinger. Additionally, the pick 10 as described above may be anodized with metallic oxide coatings of a variety of colors. Such coatings inhibit oxidation and discoloration of the various surfaces of the pick 10 and prevent transfer of any surface discoloration from the pick 10 to the musician's fingers and thumbs. The aircraft aluminum composition of the preferred embodiment is particularly suited to such anodizing.

The pick 10 as depicted in the Figures and as described above is composed of relatively soft metal such as aircraft aluminum, which is generally softer than most metallic strings of guitars and like instruments. This facilitates a "biting" form of frictional engagement of the pick 10 and string. The result is a better harmonic attack of the string than is possible with hard metal, e.g., stainless steel, picks lacking rounded bevelled tips. The superior tones generated by engagement of the pick 10 of the present invention also allows for generation of a more focused and sustainable frequency through an amplifier. On the other hand, the composition of the pick 10 of the present invention is of sufficient hardness and integrity so as not to be shaved off or rapidly worn down as the metallic strings are plucked, such as might occur with a pick composed of stone material, for example.

A pick 10 of composition and configuration as described above is relatively non-resilient in comparison to thin metallic picks composed of, for example, beryllium copper alloy or in comparison to plastic picks. In combination with a bevelled tip portion 30 as described above and as depicted in the Figures, such non-resiliency facilitates a precise articulation of the strings, a precision not practically feasible with resilient picks. Also, the symmetrical bevelled configuration of the preferred embodiment described above allows for equally effective downward and upward motions of the pick 10 for string engagement.

Having disclosed the subject matter of this invention, it should be apparent that many substitutions, modifications and variations of the invention are possible in light of the above teachings. It is therefore to be understood that the invention as taught and described herein is only limited to the extent of the breadth and scope of the appended claims.

I claim:

1. A plectrum for stringed instruments, comprising:

a generally planar upper surface and an opposed, generally planar lower surface oriented generally parallel to said upper surface, said surfaces defining a tip portion and a gripping portion; and a peripheral edge extending between said upper and lower surfaces, said peripheral edge presenting a gripping portion edge and a tip portion edge comprised of right and left tip portion edges, said right and left tip portion edges presenting right and left, generally linear margins, said right and left linear margins intersecting to present a plectrum tip apex, and each of said right and left tip portion edges presenting a generally planar upper bevelled surface and a generally planar lower bevelled surface extending from said upper surface and said lower surface respectively and intersecting along said right and left linear margins respectively, said plectrum tip portion being rounded along said tip apex to present a radiused transverse tip margin, the radius of said transverse tip margin being not more than about 0.05 mm and not less than about 0.01 mm.

2. A plectrum for stringed instruments, comprising:

a generally planar upper surface and an opposed, generally planar lower surface oriented generally parallel to said upper surface, said surfaces defining a tip portion and a gripping portion; and a peripheral edge extending between said upper and lower surfaces, said peripheral edge presenting a gripping portion edge and a tip portion edge comprised of right and left tip portion edges, said right and left tip portion edges presenting right and left, generally linear margins, said right and left linear margins intersecting to present a plectrum tip apex, and each of said right and left tip portion edges presenting a generally planar upper bevelled surface and a generally planar lower bevelled surface extending from said upper surface and said lower surface respectively and intersecting along said right and left linear margins respectively, said plectrum tip portion being rounded along said tip apex to present a radiused transverse tip margin and a radiused normal tip margin extending between said upper bevelled surface and said lower bevelled surface and oriented generally normal to said transverse tip margin, the radius of said normal tip margin being not more than about 0.03 mm and not less than about 0.005 mm.

3. The invention of claim 1 or 2, said plectrum being composed of a non-resilient material.

4. The invention of claim 3, said nonresilient material comprising aircraft aluminum.

* * * * *